US006106034A

United States Patent [19]

Allen

[11] Patent Number: 6,106,034

[45] Date of Patent: Aug. 22, 2000

[54] RELEASABLE LATCH FOR PLASTIC MOLDED CLAMSHELL PARTS

[75] Inventor: Dillis V. Allen, Elgin, Ill.

[73] Assignee: Vardon Golf Company, Inc., Elk Grove Village, Ill.

[21] Appl. No.: 09/290,947

[22] Filed: Apr. 13, 1999

Related U.S. Application Data

[63] Continuation of application No. 08/863,463, May 27, 1997.

[51] Int. Cl.[7] ..... E05C 3/04

[52] U.S. Cl. ..... 292/241; 292/202; 220/318

[58] Field of Search ..... 220/756, 325, 220/318, 315, 760; 292/4, 57, 58, 114, 170, 181, 198, 203, 241, 240, 246, 336.3, DIG. 7, DIG. 10, DIG. 11

[56] References Cited

U.S. PATENT DOCUMENTS

| | | | |
|---|---|---|---|
| 974,116 | 11/1910 | Bray | 220/318 |
| 1,201,722 | 10/1916 | Halteman | 292/205 |
| 2,301,078 | 11/1942 | Perron | 292/202 |
| 4,290,633 | 9/1981 | Sullivan | 292/114 |
| 4,351,448 | 9/1982 | Ingersoll | 220/318 |
| 4,807,914 | 2/1989 | Fleming | 292/48 |
| 4,973,092 | 11/1990 | Godbe | 292/190 |
| 5,042,855 | 8/1991 | Bennett | 292/241 |
| 5,462,015 | 10/1995 | Murphy | 119/19 |

*Primary Examiner*—B. Dayoan
*Assistant Examiner*—Gary Estremsky
*Attorney, Agent, or Firm*—Dillis V. Allen, Esq.

[57] ABSTRACT

A rotary latch for a clamshell housing with truncated circular upper and lower lugs, that can if desired, be made in a single plastic molding and rotatably attached to the housing without any rivets, pins or screws. The upper lug has an arcuate extent of more than 180 degrees and the lower lug has an arcuate extent coaxial with the upper lug but less than 180 degrees. The latch is an annular plastic body that is deformed to snap over and rotatably mount on the upper lug, effected by an annular recess in the body that extends 360 degrees inside around the body so as the body rotates on the upper lug, it never loses contact over any portion thereof. The lower lug is axially offset from the upper lug and the latch body has a latch cup portion that scoops and aligns the lower lug with the upper lug in three orthogonal coordinates. The latch cup portion is also axially offset from the upper lug so it can pass behind the upper lug as the latch body is rotated from a latch position to a release position.

8 Claims, 2 Drawing Sheets

RELEASABLE LATCH FOR PLASTIC MOLDED CLAMSHELL PARTS

RELATED APPLICATION

This application is a continuation of U.S. patent application, Ser. No. 08/863,463, Filed: May 27, 1997, entitled "RELEASABLE LATCH FOR PLASTIC MOLDED CLAMSHELL PARTS".

BACKGROUND OF THE INVENTION

With the increasing popularity of selling products in packages that can be used after purchase to store and organize the product, there is an increasing need to develop fasteners for releasably holding the package in a closed position. Instead of referring to such devices as packages or packaging herein, they are in reality organizer housings, and the most common takes the form of a plastic housing made in mating halves, hinged at one side, and selectively fastened at the other; in short, a suitcase or brief case type assembly but at a lower cost, because the product housed, for example, may be a set of socket wrenches selling retail for $12.99 U.S., so a package for a product of this type cannot substantially increase the retail price of the housed assembly above the cost of the selling price of the sockets alone, or the customer will simply purchase the socket set without the releasable housing.

There have, in the past, been designed housings for this purpose, and one is a polyurethane clamshell housing for a socket set that includes lugs integrally molded with the housing halves, and linearly slidable clasps slidably mounted on one of the lugs which capture the other lug as it is shifted linearly.

This design is attractive from an economic standpoint because it requires a simple, one-piece plastic molding for the clip or clasp. But on the negative side, alignment of the lugs is very difficult and usually requires the manual bending of portions of the housing to align the lugs to a position where the lug can, in fact, be captured by the sliding clasps.

The present one-piece rotary latch seeks to over-come not simply the inadequacies in the one-piece sliding latch described above, but also the deficiencies in multiple piece rotary latches whose deficiencies are already evident by that description and others are present that will become apparent herein.

The prior art of rotary latches falls into two fairly well-defined categories; the first being the most conventionally styled latches that have a rotary pivot post or pin carried by the associated housing that serves as a support for the latch on the housing and also the rotary bearing between either the latch and the post or the post and the housing. These latches are usually somewhat unstabled because they are bearinged only at a very narrow central portion on the housing, and they are not suitable for low cost latches because they usually require the manufacture of three or more parts.

In the second category of latches, an upper lug is provided for rotatably mounting the latch. In these designs, a central fastener is required in addition to the upper lug because as the latch is rotated to the unlatched position, the latch loses contact with a large part of the upper lug.

The Murphy, U.S. Pat. No. 5,462,015; the Sellers, U.S. Pat. No. 42,994; the Youngblood, U.S. Pat. No. 135,873; the House, U.S. Pat. No. 163,201; the Halteman, U.S. Pat. No. 1,201,722; the Thomas, et al., U.S. Pat. No. 1,257,051, and the Perron, U.S. Pat. No. 2,301,078, fall into Category 1, and the Godbe, et al., U.S. Pat. No. 4,973,092, falls in Category 2.

A further deficiency in these prior art patents is that they do not align the housing sections in all three orthogonal coordinates; i.e., x, y and z coordinates. This is extremely important in low cost housings that are flexible and are not inherently self-aligning.

It is a primary object of the present invention to ameliorate the problems noted above in prior latch assemblies and provide an improved low cost latch for clamshell-type housings.

SUMMARY OF THE PRESENT INVENTION

In accordance with the present invention, an improved rotary latch is provided for a clamshell housing with truncated circular upper and lower lugs that can, if desired, be made in a single plastic molding and rotatably attach to the housing without any rivets, pins, screws or separate bearings. The upper lug is integrally molded with the housing and has an arcuate lip or rim that extends more than 180 degrees, and the lower lug has an arcuate extent and similar lip coaxial with the upper lug, but less than 180 degrees in extent.

Toward these ends, the present latch has an annular one-piece plastic body that is constructed of a plastic that permits it to be formed into an elliptical shape to snap over and semi-permanently rotatably mount on the upper lug without any tools or extra parts. This is effected by an internal annular recess in the body that extends 360 degrees around the body so that as the body rotates on the rim of the upper lug, it never loses bearing contact over any portion thereof.

The lower lug is axially offset from the upper lug and the latch, and the latch body has a similarly offset latch cup portion that scoops and aligns the lower lug with the upper lug in x, y and z coordinates even when the housing itself does not have any provision for alignment of the housing halves. This latch cup portion is also axially off-set from the upper lug so it can pass behind the upper lug as the latch body is rotated from a latch position to a release position.

Other objects and advantages of the present invention will appear more clearly from the following detailed description.

DETAILED DESCRIPTION OF THE PREFERRED EMBODIMENT

Figure 1:
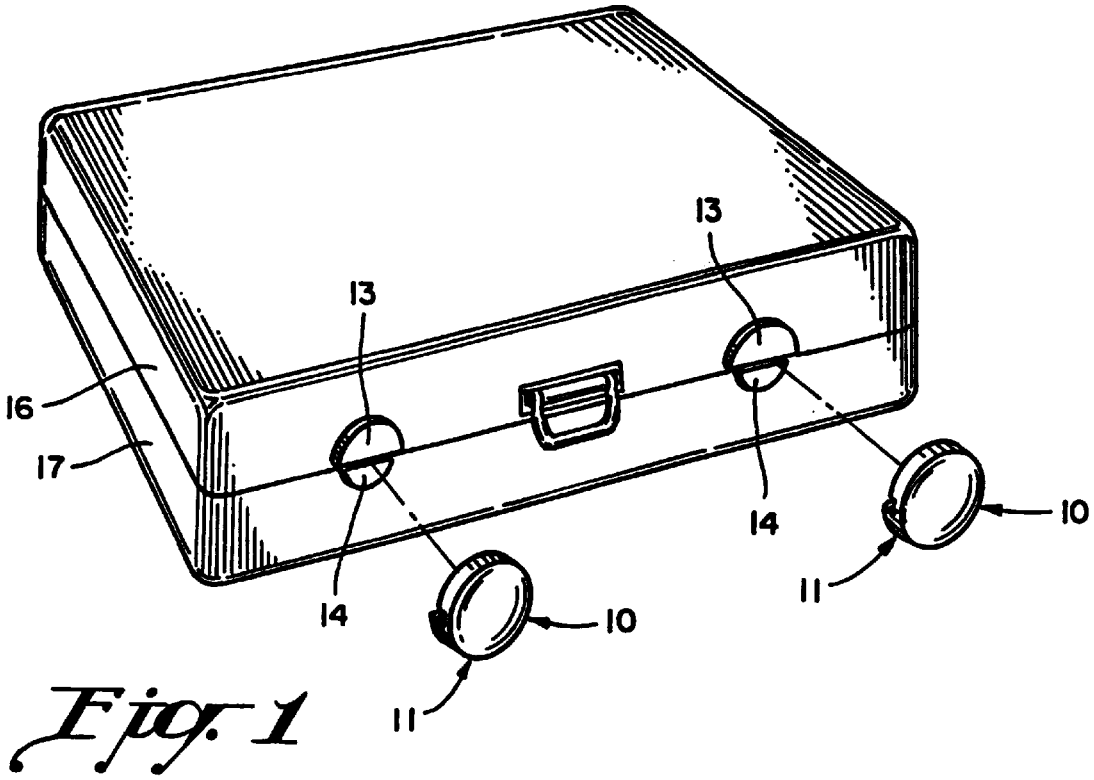
FIG. 1 is a perspective view of a clamshell housing with the present one-piece latch shown exploded from the housing.

Referring to the drawings and particularly FIG. 1, a latch assembly 10 is seen to include a latch body 11 and upper lug 13 and lower lug 14. Both lugs are molded integrally with an associated housing including upper housing half 16 and lower housing half 17 hinged at the rear in a manner similar to a brief case so that this forms the definition of a clamshell housing.

Figure 2:
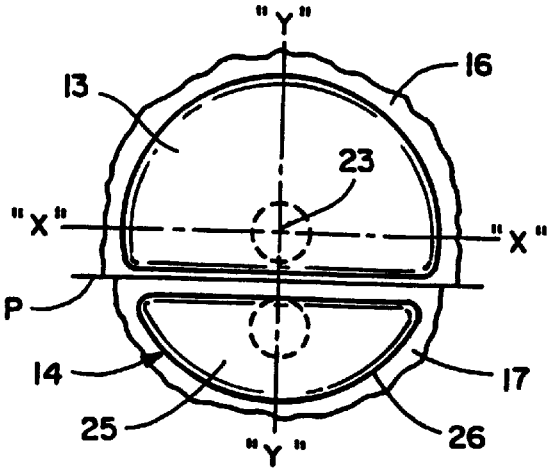
FIG. 2 is a fragmentary front view of one set of the lugs molded integrally with the housing.
Figure 3:
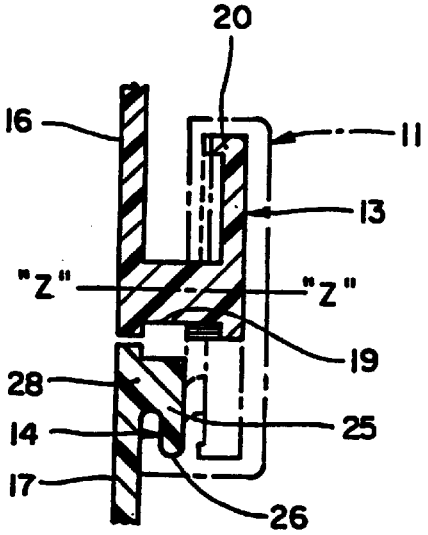
FIG. 3 is a longitudinal section through one set of housing lugs with the present one-piece latch shown in phantom.

As seen in FIGS. 2 and 3, the upper lug 13 has an arcuate extent of about 200 degrees and has a vertical planar portion 19 and a peripheral annular rearwardly extending flange 20. A post 21 is integral with both housing 16 and planar portion 19.

The rim portion 20 is arcuate about axis 23. The lower lug 14 has a planar portion 25 that is axially offset inwardly from the planar portion 19 of the upper lug 13. Planar portion 25 has an annular outer rim 26 that is arcuate about the axis 23 of the upper lug when the housing halves 16 and 17 are in their closed position. Planar portion 25 is fixed to housing portion 17 by post 28 integral with both the housing 17 and the planar portion 25.

Figure 9:
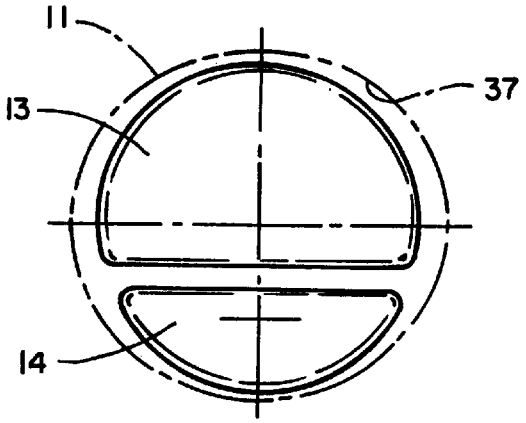
FIG. 9 is a front view of the lugs with the latch shown diagramatically in elliptical configuration as it is snapped over the upper lug 13.

The latch body 11 is a one-piece plastic molding constructed of a material that permits it to be deformed somewhat into the FIG. 9 configuration where it is snapped over the upper lug 13, without failing.

One-piece body 11 has an annular inner recess 32 defined by a forward planar portion 33, a rearwardly extending annular rim portion 34, a radially inwardly extending planar flange 36, and an axially extending annular stop portion 37.

Recess 32 extends completely around the latch body 11 so the latch can, in the absence of unshown stops, which may be utilized if desired, rotate 360 degrees around on the upper lug 13.

The latch body 11 is assembled to the upper lug 13 by deforming it vertically into an ellipse as shown in FIG. 9, passing it over the lug 13 and releasing it so that the recess 32 snaps over the rim portion 20 and onto its fully seated position on lug 13.

The one-piece body 11 includes a latch cup portion 40 that has an arcuate extent about axis 23 of about 80 degrees, and it has an arcuate upwardly opening recess 41 defined by arcuate side walls 42 and 43.

Figure 7:
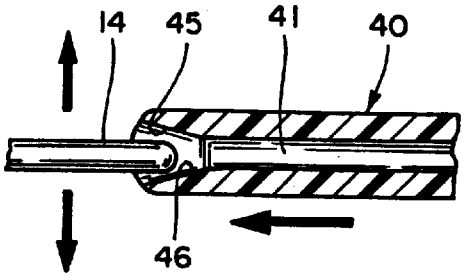
FIG. 7 is an arcuate section through the latch cup portion showing its lead in surfaces.
Figure 8:
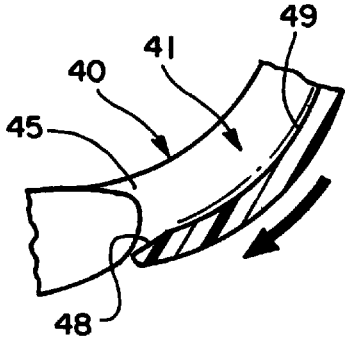
FIG. 8 is a cross section through the slot of the latch cup portion leading in the lower housing lug.

As seen in FIG. 7, the inner surfaces of the side walls 42 and 43 and outwardly diverging surfaces 45 and 46 that cam the lower lug 14 into its correct "z" axis orientation. The lower surface 49 of the recess 41 has an outwardly diverging portion 48 that guides the lug 14 onto an axis coincident with axis 23. Surface 49 is conincident with axis 23.

Figure 4:
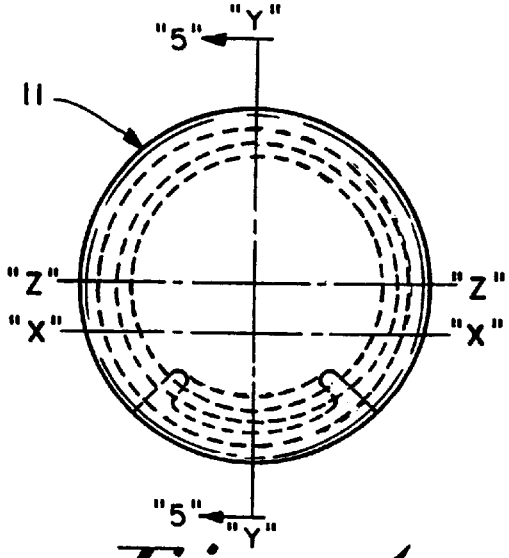
FIG. 4 is a front view of the present one-piece plastic molded latch.
Figure 5:
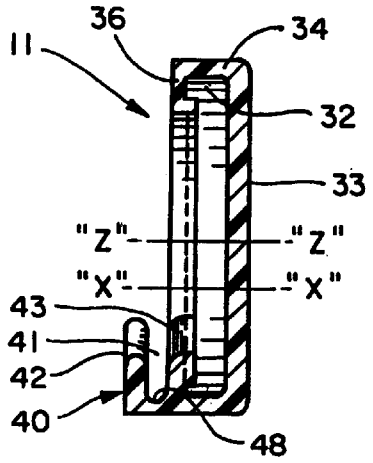
FIG. 5 is a cross section of the one-piece molded latch according to the present invention taken along line 5—5 of FIG. 4.
Figure 6:
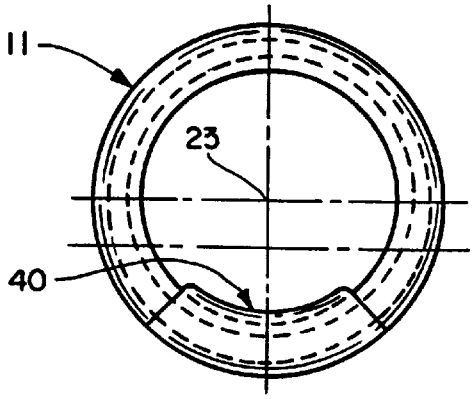
FIG. 6 is a rear view of the latch illustrated in FIG. 4.

As the latch member 11 is rotated from its latching position in engagement with the lower lug 23, to its unlatched position rotated about 90 degrees from the position of the latch shown in FIGS. 4 and 6. In doing so, the latch cup portion 40 rotates upwardly and behind the upper lug 13 so that there is no interference there-between.

What is claimed is:

1. A plastic molded latch assembly for a housing comprising: closely spaced upper and lower lugs for the housing selectively positionable adjacent one another, one of the lugs having an arcuate extent of at least 180 degrees, said one lug being generally arcuate, a generally circular latch body rotatably mounted on said one lug movable rotationally from a latch position to a release position, said body having a latching portion selectively engageable with the other lug to hold the housing selectively in a closed position and being slidably engaging and rotatable on the other lug, and means for rotatably mounting the latch body on the one lug without a central pivot pin separate from the one lug including an arcuate perimeter member in the latch body engageable with a major portion of the one lug perimeter surface in both the latch position and the release position of the latch body, said means for rotatably mounting the latch body on the one lug including means for preventing removal of the latch body from the one lug except by distorting or modifying the latch body including an annular recess in the arcuate member receiving the one lug and having a flange behind and slidably engageable with the one lug, said recess and flange having an arcuate extent of at least 180 degrees, said upper and lower lugs being axially spaced from one another, said other lug having forward and rear alignment surfaces, said latching portion having a recess for receiving the other lug with axially spaced surfaces engageable with the other lug forward and rear surfaces to axially align the other lug.

2. A latch assembly for a housing comprising: a planar first lug having an arcuate peripheral surface extending at least 180 degrees, a closely spaced planar second lug having an arcuate peripheral surface, a generally circular latch body rotatably mounted on the first lug and having a latch portion with an arcuate recess for receiving the second lug a peripheral surface selectively engageable with the second lug, said latch portion recess being rotatably slideable relative to the second lug, said latch body being solely supported on the first lug and having an arcuate recess therein for receiving the first lug and a flange behind and slidably engageable with the first lug both extending substantially more than 180 degrees and slidably receiving the first lug arcuate peripheral surface, said latch body being rotatable from a first latching position when the latch portion engages the second lug to a second release position where the latch portion releases the second lug, said body recess receiving and locking the latch body on and engaging the first lug peripheral surface, whereby the latch body is securely mounted on the first lug, said latch portion being rotatable in the release position into the plane of the first lug, said first and second lugs being axially spaced from one another, said second lug having forward and rear alignment surfaces, said latch portion recess having forward and rear surfaces engageable with the second lug forward and rear surfaces to axially align the second lug.

3. A latch assembly, comprising: a first generally planar arcuate lug lying in a first plane having an arcuate peripheral surface, a second generally planar lug having an arcuate peripheral surface lying in a second plane axially spaced from the first plane, and a latch body rotatably mounted on the first lug peripheral surface and having a first portion engageable with the first lug peripheral surface and a second portion selective engageable with the second lug, said latch body having an arcuate radial recess therein of at least 180 degrees slidably receiving the first lug and solely supported on the first lug without pivot pins or fasteners, said second portion including an arcuate latch radial recess for slidably receiving the arcuate peripheral surface of the second lug, said second portion latch radial recess in the latch body being substantially axially spaced from the first lug and the latch body arcuate radial recess so the second portion does not interfere with the first lug as the latch body is rotated to an unlatched position, said first and second lugs being axially spaced from one another, said second lug having forward and rear alignment surfaces, said latch portion recess having forward and rear surfaces engageable with the second lug forward and rear surfaces to axially align the second lug.

4. A latch assembly as defined in claim 3, wherein the latch body is a one-piece plastic molding.

5. A latch assembly as defined in claim 3, wherein the latch body first portion is an arcuate recess in the body that receives the first lug and has an arcuate extent substantially more than 180 degrees, said first lug having an arcuate peripheral surface of at least 180 degrees received in the latch body arcuate recess.

6. A latch assembly as defined in claim 3, said second portion of the latch body including an arcuate recess for receiving the second lug, said recess having spaced side walls that taper inwardly to guide and axially align the second lug as the second portion slides over the second lug.

7. A latch assembly as defined in claim 6, wherein the second portion recess has an inwardly converging bottom wall to guide and lift the second lug toward the first lug as the second portion slides over the second lug.

8. A latch assembly as defined in claim 1, wherein the first lug has a peripheral surface of at least 180 degrees, said first portion of the latch body having an arcuate recess for receiving the peripheral surface of the first lug having an arcuate extent greater than 270 degrees so that the latch body can rotate about at least 90 degrees on the first lug.

* * * * *